US010662632B1

(12) United States Patent
Iocco et al.

(10) Patent No.: US 10,662,632 B1
(45) Date of Patent: May 26, 2020

(54) FALLEN UNDERMOUNT SINK REPAIR APPARATUS AND METHOD

(71) Applicants: Augustine Albert Iocco, Harrison City, PA (US); Matthew Augustine Iocco, Murrysville, PA (US)

(72) Inventors: Augustine Albert Iocco, Harrison City, PA (US); Matthew Augustine Iocco, Murrysville, PA (US)

( * ) Notice: Subject to any disclaimer, the term of this patent is extended or adjusted under 35 U.S.C. 154(b) by 0 days.

(21) Appl. No.: 16/188,804

(22) Filed: Nov. 13, 2018

Related U.S. Application Data

(60) Provisional application No. 62/588,127, filed on Nov. 17, 2017.

(51) Int. Cl.
*E03C 1/32* (2006.01)
*E03C 1/324* (2006.01)
*E03C 1/33* (2006.01)

(52) U.S. Cl.
CPC ..... *E03C 1/33* (2013.01)

(58) Field of Classification Search
CPC ... E03C 1/32; E03C 1/33; E03C 1/322; E03C 1/324; E03C 1/335; F16M 13/022
USPC ..... 4/631–635, 645, 647–649; 108/147.11, 108/147.16, 147.17; 248/244, 295.11, 248/544; 312/140.1, 140.3, 140.4; 29/890.141
See application file for complete search history.

(56) References Cited

U.S. PATENT DOCUMENTS 590,872 A * 9/1897 Allen ..... E06C 7/426 182/45
597,503 A * 1/1898 Lanahan ..... E03C 1/33 4/649
1,116,091 A * 11/1914 McDonald ..... A47B 57/567 248/244
1,299,234 A * 4/1919 Russell ..... A47B 57/567 248/244
1,391,091 A * 9/1921 Arbuckle ..... E03C 1/324 4/637
2,035,301 A * 3/1936 Daugherty ..... E03C 1/324 248/295.11
2,173,569 A * 9/1939 Troendle ..... B60N 3/004 297/146
2,233,342 A * 2/1941 Crozier ..... E03C 1/322 4/648
2,283,794 A * 5/1942 Crozier ..... E03C 1/324 4/648
2,457,373 A * 12/1948 Hunter ..... A47B 5/02 248/244
2,746,664 A * 5/1956 Strmic ..... A47K 1/08 182/156
2,812,521 A * 11/1957 Skinner ..... E03C 1/33 4/636

(Continued)

*Primary Examiner* — Joshua E Rodden

(57) ABSTRACT

A fallen undermount sink complete repair apparatus includes a wall bracket having at least one flange portion configured for fixedly fastening to a vertical wall and a second central portion generally perpendicular to said flange portion, with an aperture therethrough. Additionally, there is an expandable elonogated member pivotably attached at a proximal end to the wall bracket, and at the distal end of the elongated member is a sink bracket head portion generally perpendicular to that of the elongated member and configured to press against a portion of the underside rim of a detached sink.

3 Claims, 2 Drawing Sheets

(56) References Cited

U.S. PATENT DOCUMENTS 2,992,436 A * 7/1961 Camp ..... E03C 1/33 4/635
3,008,150 A * 11/1961 Lyon, Jr. ..... E03C 1/335 4/650
3,022,519 A * 2/1962 Lang ..... E03C 1/33 4/650
3,354,474 A * 11/1967 Cairns et al. ..... A47K 3/008 4/633
3,583,002 A * 6/1971 Roberts ..... E03C 1/33 4/636
3,863,878 A * 2/1975 Gregory ..... E04G 17/16 248/295.11
4,016,608 A * 4/1977 Khan ..... E03C 1/33 4/633
4,175,292 A * 11/1979 Morrison ..... E03C 1/335 4/633
4,432,106 A * 2/1984 Smith ..... E03C 1/335 4/633
5,050,253 A * 9/1991 Wasek ..... E03C 1/328 4/645
5,538,206 A 7/1996 Sather
5,669,314 A * 9/1997 Grant ..... A47B 5/00 108/20
5,743,501 A 4/1998 Rapp
5,755,411 A * 5/1998 Strong, III ..... B60N 3/007 108/44
5,867,847 A * 2/1999 Klawitter ..... E03C 1/324 312/247
6,402,111 B1 * 6/2002 Stewart ..... A47B 21/0314 248/295.11
8,794,577 B2 * 8/2014 Laera ..... E03C 1/33 248/146
10,563,387 B1 * 2/2020 Iocco ..... E03C 1/33
2003/0154546 A1 * 8/2003 Romo ..... E03C 1/33 4/633
2004/0231047 A1 * 11/2004 Ricke ..... E03C 1/33 4/633
2005/0066438 A1 * 3/2005 Hong ..... E03C 1/328 4/645
2010/0230563 A1 * 9/2010 Flynn ..... A47K 1/05 248/201
2010/0301175 A1 * 12/2010 Grayson ..... E03C 1/33 248/27.1
2015/0272353 A1 * 10/2015 Christodoulou ..... A47G 1/202 29/525.01
2019/0048568 A1 * 2/2019 Chia ..... E03C 1/335

* cited by examiner

FALLEN UNDERMOUNT SINK REPAIR APPARATUS AND METHOD

FIELD OF THE INVENTION

The present invention relates in general to a sink repair system and more particularly, this invention relates to a system that will repair a fallen detached sink from a countertop.

BACKGROUND OF THE INVENTION

The desirability of reattaching a fallen sink has always been laborious and time consuming and having the need to remove the entire sink, plumbing supply lines and drains along with garbage disposals. The many types of sink brackets available in the market place pose different types of installation techniques but none of the prior art addresses reinstalling the sink by pushing the sink back into place. Information relevant to attempt to address this problem cap be found in one exemplary type of crossmember suitable for the purpose of supporting sinks is described in U.S. Pat. No. 7,429,021 another exemplary crossmember suitable for use as a crossmember is described in U.S. Pat. No. 5,538,206.

SUMMARY OF THE INVENTION

The present invention provides a method of reattaching a sink to the countertop without the need to remove the sink, plumbing supply lines, drains or any other accessories like garbage disposals etc. The wall bracket of the never fall sink repair system attaches to the side wall of the cabinet the bracket is then connected to a cylindrical threaded shaft that acts as a turnbuckle. At the opposite end of the turnbuckle is a double headed sink bracket that engages the rim of the sink, when turning the shaft of the turnbuckle in turn pushes the sink back up into place. Time is significantly reduced by not having to remove the sink.

OBJECTS OF THE INVENTION

It is therefore one of the primary object of the present invention is to provide a fast simple economical way of reattaching an undermount sink to the countertop. Another object of the present invention is to provide a turnbuckle action which by turning the shaft of the turnbuckle will raise the sink back into place.

Still another object of the present invention is to provide a double back adhesive tape for the back of the cabinet wall bracket to ease in the installation of the wall bracket.

An additional object of the present invention is to provide a double headed sink bracket that will engage the sink rim in two locations.

Still another object of the present invention is to provide a double headed sink 15 bracket that will pivot in the middle and bridge the gap in any irregularities in the sink rim.

An additional object of the present invention is to have a wall bracket that would be attached to the cabinet wall. Still another object of the present invention is to provide a lock nut that would stop the turnbuckle from loosing due to vibrations from the garbage disposals or from a thermal action.

In addition to the various objects and advantages of the present invention described with some degree of specificity above, it should be obvious that additional objects and advantages of the present invention will become more readily apparent to those persons who are skilled in the relevant art from the following more detailed description of the invention, particularly, when such description is taken in conjunction with the attached drawing figures and with the appended claims.

DETAILED DESCRIPTION OF A PRESENT PRESENTLY PREFERRED AND VARIOUS ALTERNATIVE EMBODIMENTS OF THE INVENTION

Figure 1:
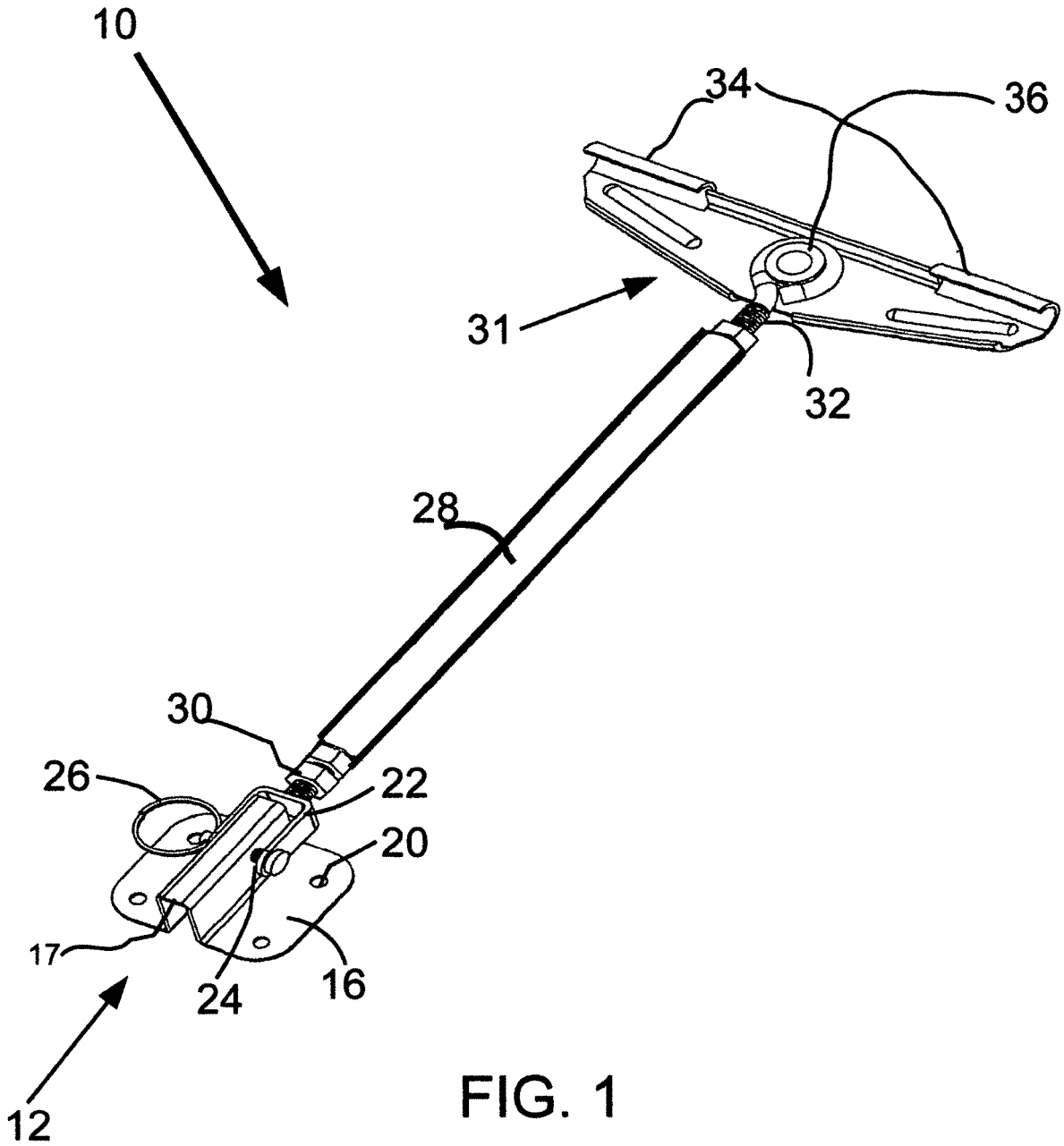
FIG. 1 Illustrates a perspective view of the preferred embodiment of the present invention in the use.
Figure 2:
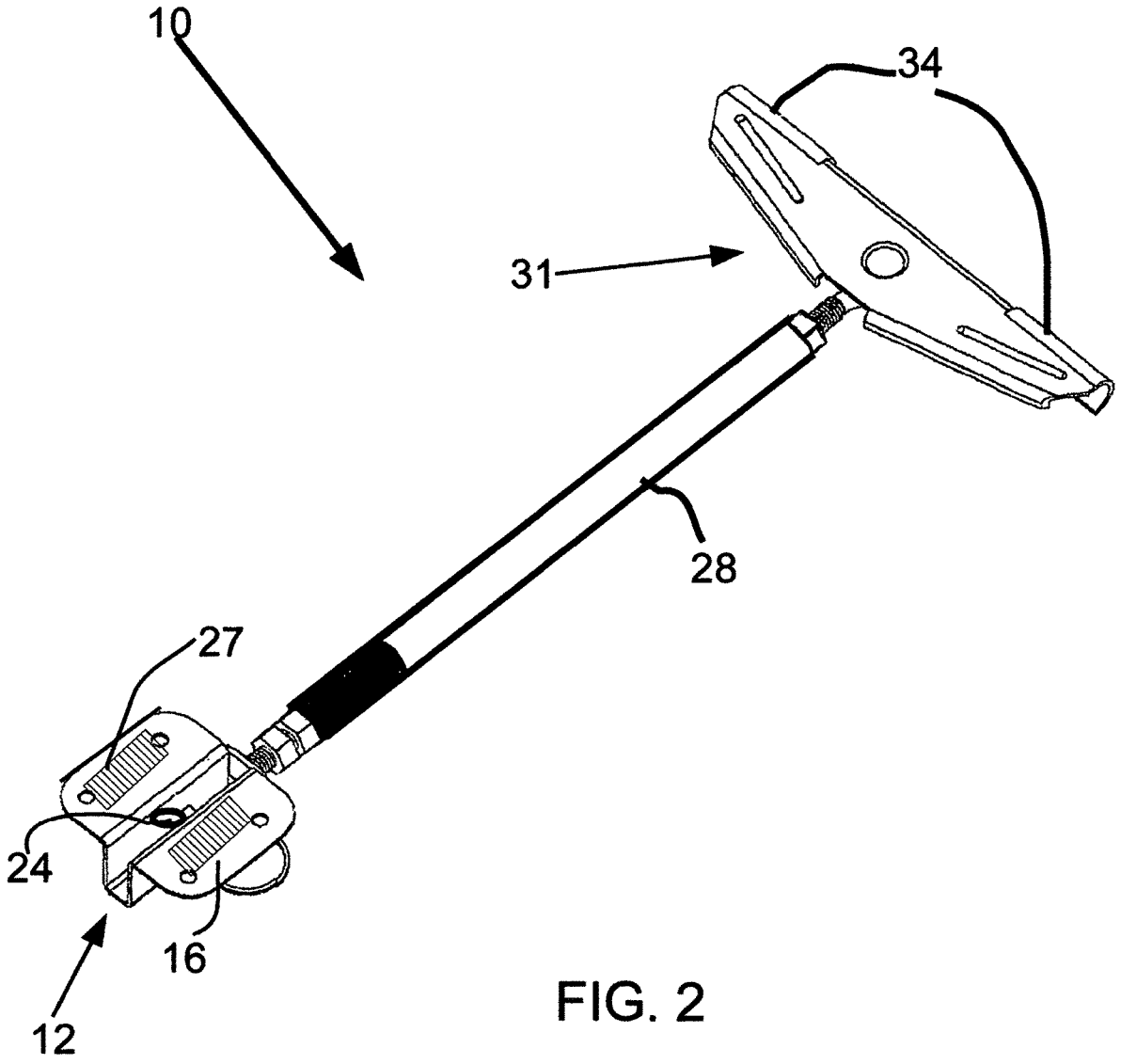
FIG. 2 Provides a perspective profile view of the present invention.

Prior to proceeding to the more detailed description of the present invention it should be noted that, for the sake of clarity and understanding, identical components which have identical functions have been identified with identical reference numerals throughout the several views illustrated in the figures. Referring initially to FIG. 1, then FIG. 2, this illustrates a perspective view of a preferred embodiment of the present sink repair bracket invention 10. A cabinet wall bracket 12 is temporarily attached to the cabinet wall by way of a double-sided adhesive tape 27 which is attached to the flanges 16 on back of the wall bracket 12. The wall bracket 12 is then secured in place by four screws 18 through mounting holes 20 and the jaw 22 is attached to cabinet wall bracket 12 by pin 24 through the channel 17 and retainer clip 26. The jaw 22 is threaded on to turnbuckle 28 by way of a right hand thread there is also a lock nut 30 at this point. Top of the turnbuckle 28 is threaded on to an eye bolt 32 with a left-handed thread. Eye bolt 32 is attached to the double headed bracket 31 by way of rivet 36 creating a pivoting action. The double heads 34 of bracket 31 engage the rim of the sink 38 by turning the shaft of the turnbuckle.

We claim:

1. A fallen sink complete repair apparatus comprising:

a) a wall bracket configured for substantial weight bearing, said wall bracket having at least one flange portion configured for fixedly fastening to a vertical wall and a second central portion generally perpendicular to said flange portion, said central portion including at least one aperture therethrough;

b) an expandable elongated member having a preselected minimum length with an overall length adjustable via at least one threaded portion, said elongated member pivotably attached at a proximal end to said central wall bracket portion, and;

c) a sink bracket head portion centrally attached to a distal end of said elongated member and generally perpendicular to that of said elongated member, said sink bracket portion configured to press against a predetermined portion of an underside rim of a detached sink.

2. The apparatus of claim 1, wherein a sink bracket head portion has two sink-contact pads at opposing ends of a top edge of said sink bracket portion.

3. The apparatus of claim 1, wherein said elongated member is a turnbuckle shaft with two threaded portions and a lock nut adjacent said proximal end.

* * * * *